United States Patent [19]

Angelucci et al.

[11] Patent Number: 4,555,067

[45] Date of Patent: Nov. 26, 1985

[54] TEXTILE DOFF SERVANT

[75] Inventors: Richard J. Angelucci, Springfield, Pa.; Andrew P. Cope, Wilmington, Del.; Donald E. Hallam, Wilmington, Del.; Harry E. Ladd, Wilmington, Del.

[73] Assignee: E. I. Du Pont de Nemours and Company, Wilmington, Del.

[21] Appl. No.: 613,648

[22] Filed: May 24, 1984

[51] Int. Cl.[4] ..... B65H 54/20; B65H 54/26; B65H 67/06

[52] U.S. Cl. ..... 242/35.5 A; 414/222

[58] Field of Search ..... 242/35.5 A, 35.5 R, 242/35.6 R, 18 A, 25 A; 57/268, 270, 271, 272; 414/222, 279, 284

[56] References Cited

U.S. PATENT DOCUMENTS

| | | | |
|---|---|---|---|
| 3,765,160 | 10/1973 | Bethea et al. | 57/270 X |
| 3,854,275 | 12/1974 | Bethea et al. | 57/268 X |
| 3,881,603 | 5/1975 | Stotler et al. | 242/35.5 A X |
| 4,007,882 | 2/1977 | Isoard | 242/35.5 A X |
| 4,023,743 | 5/1977 | Schippers | 242/35.5 A |
| 4,039,092 | 8/1977 | Schar | 242/35.5 A X |
| 4,041,686 | 8/1977 | Inaba et al. | 242/35.5 A X |
| 4,052,017 | 10/1977 | Schar | 242/35.5 A |
| 4,069,983 | 1/1978 | Muramatsu et al. | 242/35.5 A |
| 4,138,072 | 2/1979 | Aoyama et al. | 242/35.5 A |
| 4,153,211 | 5/1979 | Lenk et al. | 242/35.5 A |
| 4,226,567 | 10/1980 | Van Orsdale, Jr. | 242/35.5 A X |
| 4,305,551 | 12/1981 | Cockshott et al. | 242/35.5 A |
| 4,309,000 | 1/1982 | Schefer et al. | 242/35.5 A X |
| 4,340,187 | 7/1982 | Schippers et al. | 242/35.5 A |
| 4,427,158 | 1/1984 | Conrad | 242/35.5 A |

*Primary Examiner*—Stanley N. Gilreath

[57] ABSTRACT

A power-driven, wheeled vehicle which interacts semi-automatically with winders in a spinning area to doff completed yarn packages, automatically delivers the packages to an unload station to unload the packages from the vehicle and then moves to another winder to repeat the operation. The wheeled vehicle and the winders are located on opposite sides of a service aisle. A frame extendable and retractable across the aisle is mounted to the vehicle. The means for extending and retracting the frame includes two four-bar linkages coupled to the vehicle and the frame and to each other.

2 Claims, 16 Drawing Figures

TEXTILE DOFF SERVANT

BACKGROUND OF THE INVENTION

This invention relates generally to the packaging of synthetic yarn, and more particularly, it relates to doffer mechanisms for use with winding apparatus for winding synthetic yarn.

The apparatus of the present invention is a semi-automatic textile doff servant which interfaces with push-off windups and under operator control receives a plurality of packages, transports them to the aisle end, and discharges them to an unload station. The doff servant is a floor-mounted power driven vehicle which extends and retracts a receiving frame across a 42" service aisle to allow for operator access to the windup.

Numerous solutions have been proposed for the doffing/donning problem, that is, the removal of a full package from a revolver chuck and its replacement with an empty bobbin. In many current operations, intense manual labor in handling weighty yarn packages is required. Fully automatic doffing systems have been proposed, as for example, in Schippers et al U.S. Pat. No. 4,340,187. However, such complex systems require substantial capital investment, and present a number of operating and maintenance problems. Thus, a need exists for a relatively simple system, dependent on operator attendance, but one which will operate in safety without undue interference in the service area.

Cockschott et al. U.S. Pat. No. 4,305,551 recognizes that operator access to the threadline is made difficult and hazardous by the permanent presence and operational movement of bobbin transfer rotors in front of the windups; and therefore, provides an operator platform above the bobbin exchange rotors, providing access to the winders in their upper position. Similarly, Schefer et al. U.S. Pat No. 4,309,000 recognizes the need for unobstructed service by personnel in front of the winding machine, and propose a doffing carriage which is reciprocable along rails for moving between a retracted position spaced beneath the chuck, and an extended position spaced from the chuck.

SUMMARY OF THE INVENTION

The proposed invention uses a floor-mounted power driven vehicle, spaced from push-off type windups to allow unobstructed operator access. The vehicle extends and retracts a receiving frame under operator control for doffing yarn packages from the chucks of push-off windups. More particularly, a carriage is mounted for movement in a spaced relationship from the windup in order to provide a service aisle and a receiving frame is housed within the carriage with four receiving rods. The receiving frame is extendable under operator control across the service aisle, and the receiving rods align with the chucks on the windup to receive a plurality of doffed packages upon operator actuation of the push-off mechanism of the push-off windup. The vehicle automatically delivers the packages to an unload station at the end of the machine aisle. Push-off means on the carriage associated with the receiving rods provide for unloading of the doffed packages.

DETAILED DESCRIPTION OF THE PREFERRED EMBODIMENT

Figure 1:
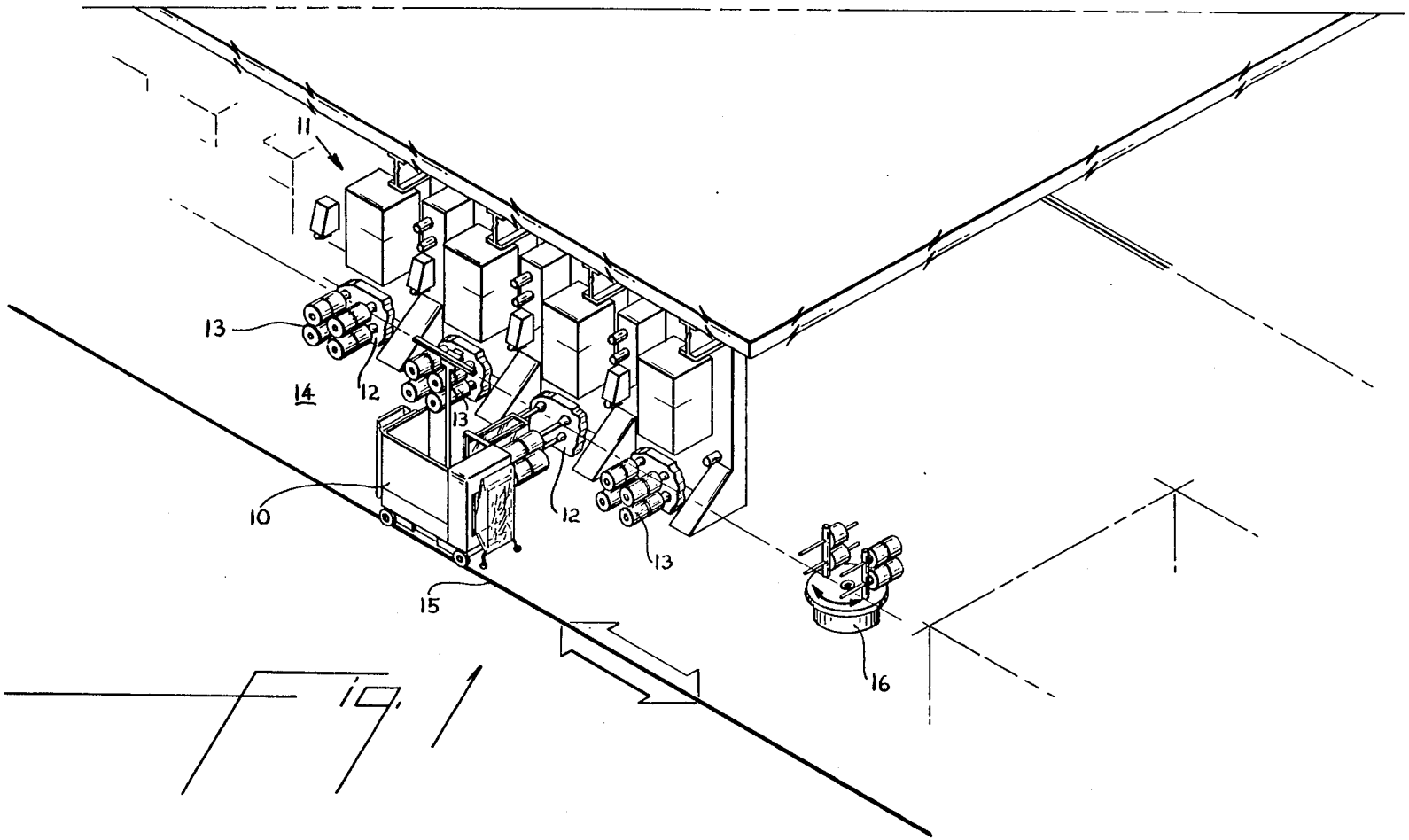
FIG. 1 is a perspective diagram of a spinning area showing a doff servant in spaced relationship to a push-off winder and showing an unload station.
Figure 2:
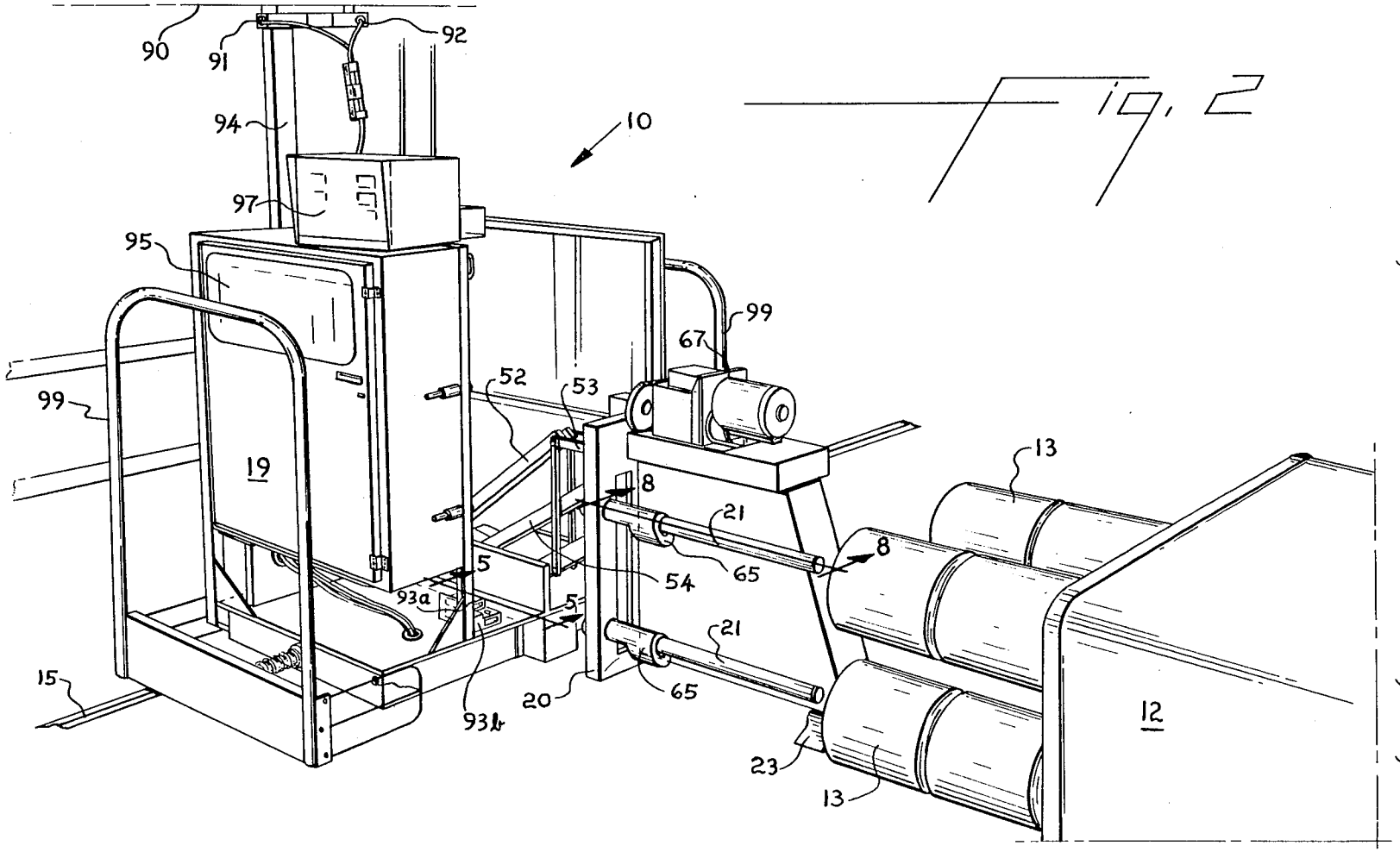
FIG. 2 a front perspective view of a doff servant with extended receiving frame in alignment with the windup chucks.
Figure 3:
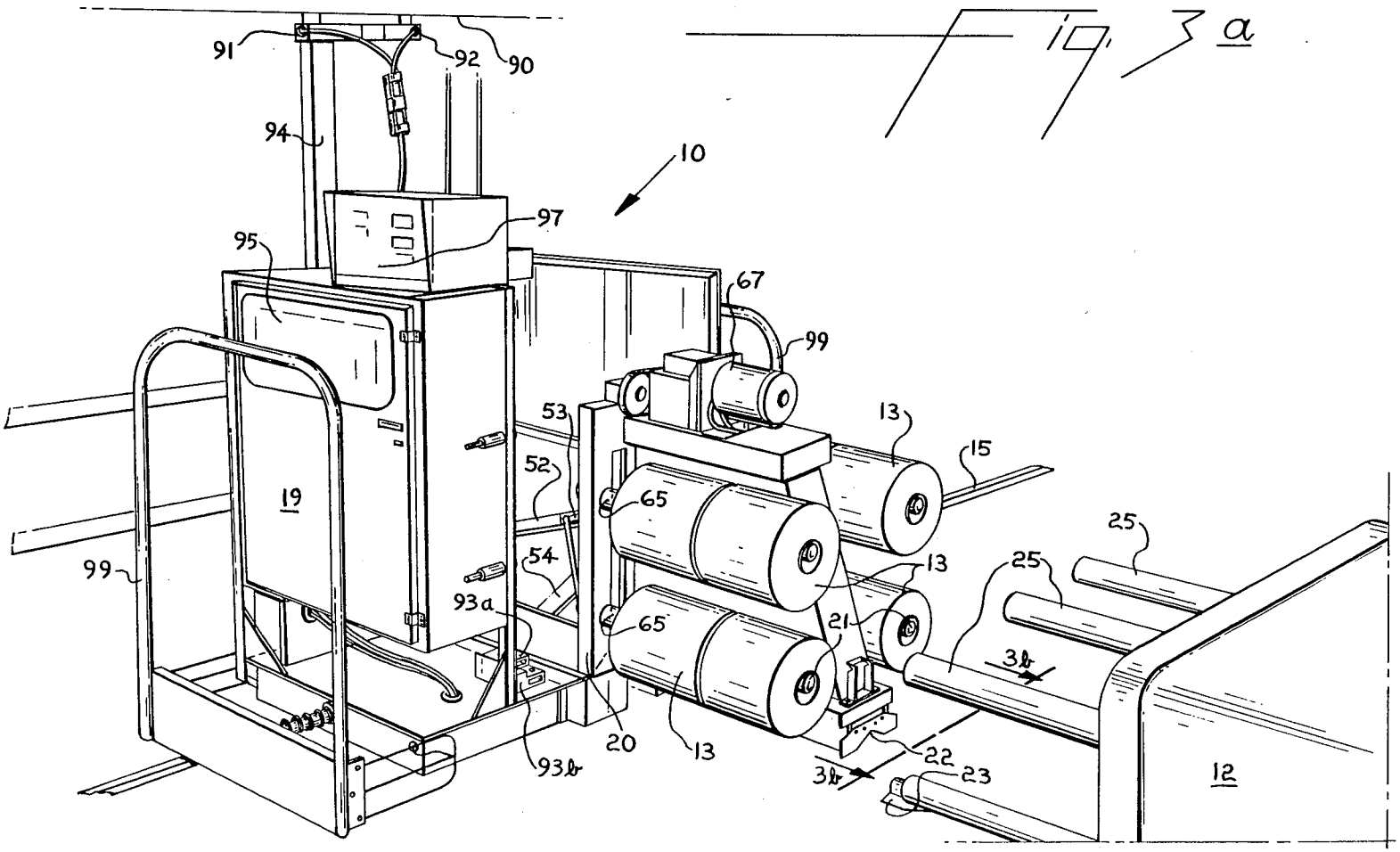
FIG. 3*a* is a front perspective view of a doff servant which has received eight packages from the push-off winder.
FIG. 3*b* is a front view of the winder showing the alignment bar.
Figure 3B:
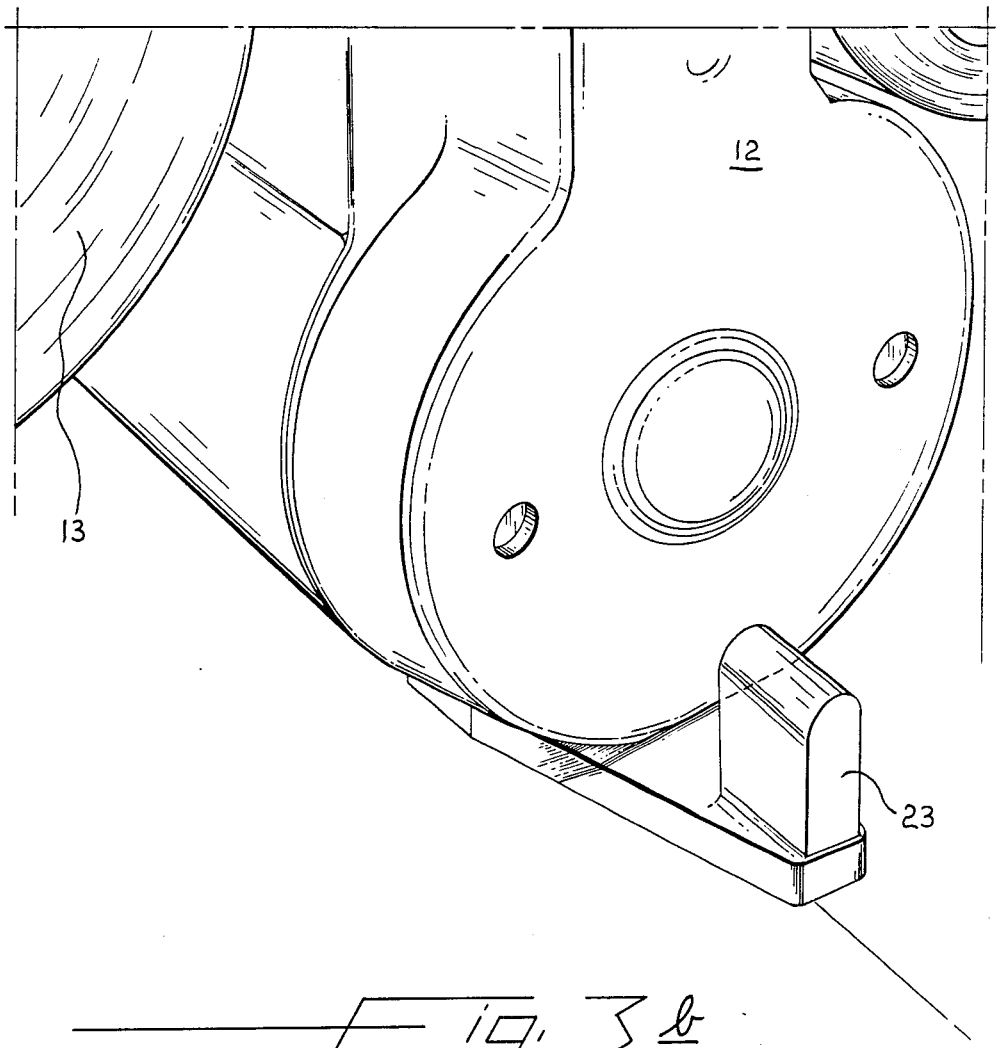
Figure 4:
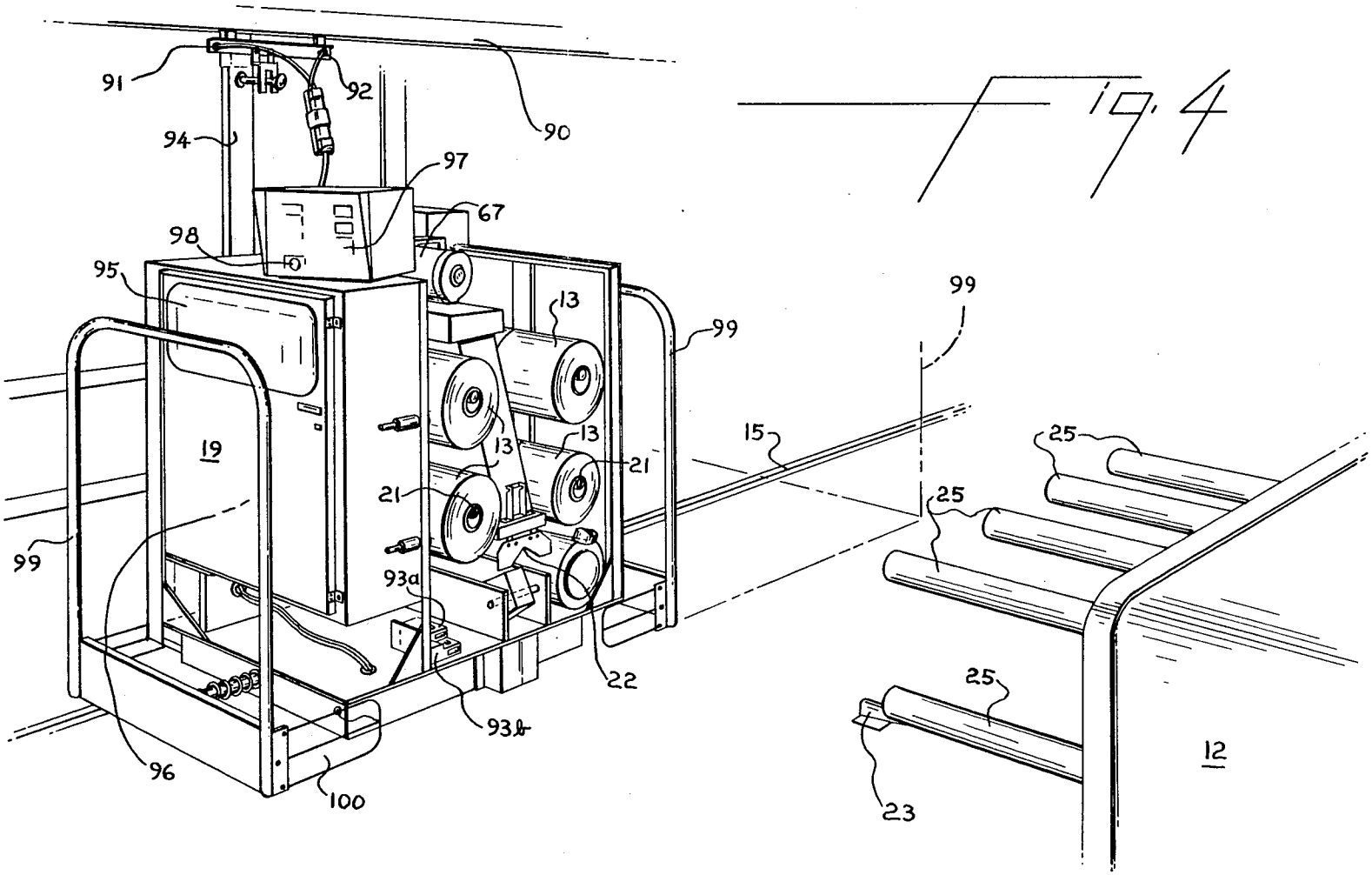
FIG. 4 is a front perspective view of a doff servant in travel mode in spaced relationship to a push-off winder.

Referring to FIG. 1, the doff servant 10 is located nearby to a fiber spinning area 11 in which yarn is delivered from individual spinning positions to each of a plurality of push-off winders 12 which produce yarn packages 13 having rotational axes which are in a plane parallel to the plane of a working or service aisle 14. A 42" aisle 14 is provided between doff servant 10 and push-off winders 12 to allow for operator access to the winder. Power is transmitted to the servant through an overhead rail and trolly arrangement. The servant 10 is floor mounted on power driven wheels guided by alignment track 15 and travels along both directions of a path parallel to the spinning machine. The doff servant 10 interfaces with push-off winders 12 and under operator control receives eight packages, transports them to the aisle end, and discharges them onto unload station 16.

As best shown in FIGS. 2, 3*a*, 3*b* and 4, the servant 10 comprises a carriage 19 mounted for movement in spaced relationship from the winder and a receiving frame 20 housed within the carriage. The servant 10 is directed by an off board programmable controller to a doff location. When the servant is positioned in front of a winder 12 ready for doffing, the receiving frame 20 with four receiving rods 21 is extended under operator control across the service aisle. Alignment of the receiving rods with the windup chucks 25 is assured by mating "V" groove 22 (FIGS. 3*a* and 3*b*) on the servant's frame with an alignment bar 23 on winder 12.

The overhead power rail 20 supplies the servant with 240 volt power through twin power trollies 91 and 92. Coded position information is attached to the overhead power rail which provides information for automatically precisely positioning and identifying the location of the servant. The servant communicates with an off board programmable controller at unload station 16 by means of two optical sensors 93*a*, 93*b* (one emitter and one receiver) located on the base of the doff servant. The area control computer is used to schedule doffing in a random mode. When the servant unloads the packages at the unload station, it receives a doff position number for the next doffing location. Another pair of optical sensors 94*a*, 94*b* are located on the mast of the servant facing the back surface of the power rail 90. The servant uses this pair of optical sensors to look at reflective tape applied to the side of the power rail. As the servant passes a pair of tapes, it either increments or decrements a position counter in the programmable controller 95 housed within control cabinet 96.

Figure 10:
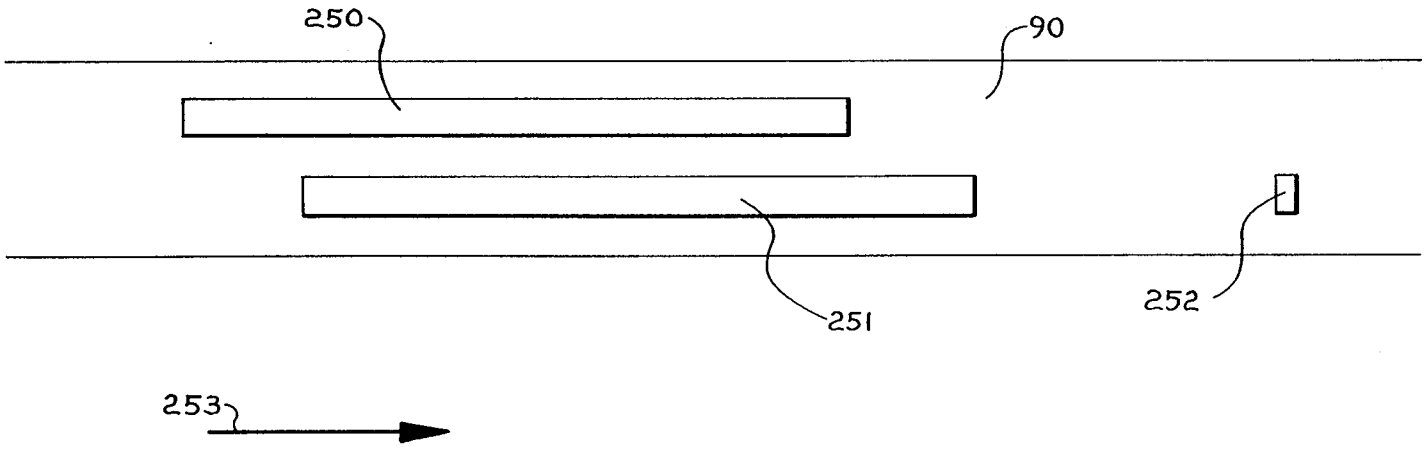
FIG. 10 is an illustration of reflective tapes on the power rail.

FIG. 10 shows the configuration of the reflective tapes on the power rail. If the servant is traveling in the direction of arrow 253, then optical sensor 93*a* will detect the reflective strip 250 before sensor 93*b* detects strip 251 and thus will increment the position counter. If the servant travels in the direction opposite to arrow 253, sensor 93*b* will detect strip 251 first and decrement the position counter. In this manner, the servant can keep track of its location and direction of travel. As the servant approaches a doff location, it decelerates to creep velocity and then looks with its lower sensor for the final stop tab 252 on the power rail. Upon sensing the tab, power is cut to the drive motor and the servant is stopped within $\pm\frac{1}{4}$" of the centerline of the windup. The doff servant is a semi-automatic device controlled with programmable controller 95. Operator interaction is effected by means of a operator control panel 97. On the operator control panel is travel/doff switch 98. When the switch is in travel position, the servant can automatically travel up and down the aisle, but it cannot extend the receiving frame as the linkage motor 56 is disabled. When the switch is in doff position, the frame can then be extended, but the transport motor 85 and the push-off motor 67 are locked out. Thus, the operator can operate the frame without the possibility of the servant moving up and down the aisle. Four additional buttons are incorporated into the operator panel—a release button which allows travel, an extend and retract button which operates the frame, a push-off solenoid button which activates the winder push-off mechanism, and a fault acknowledge button.

There are safety bumpers 99 on the doff servant to stop the servant upon encountering an object in its path. A bumper consists of a light-weight tubular aluminum frame with a Mylar® polyester film panel, and a cushion on the bottom to reduce impacts. The bumper frame is supported by a single splined shaft bolted to the base of the servant which shaft is spring loaded in its fully extended position. Aluminum guard 100 mounted on the base of the servant prevents an operator's foot from entering the space between the base of the servant and the tubular bumper frame. Any deflection on safety bumper 99 causes the guard 100 to actuate a limit switch in the emergency stop circuit which cuts power to transport motor 85 and applies voltage to brakes on the transport motor and to brake 87 mounted on free wheel 84.

Figure 5:
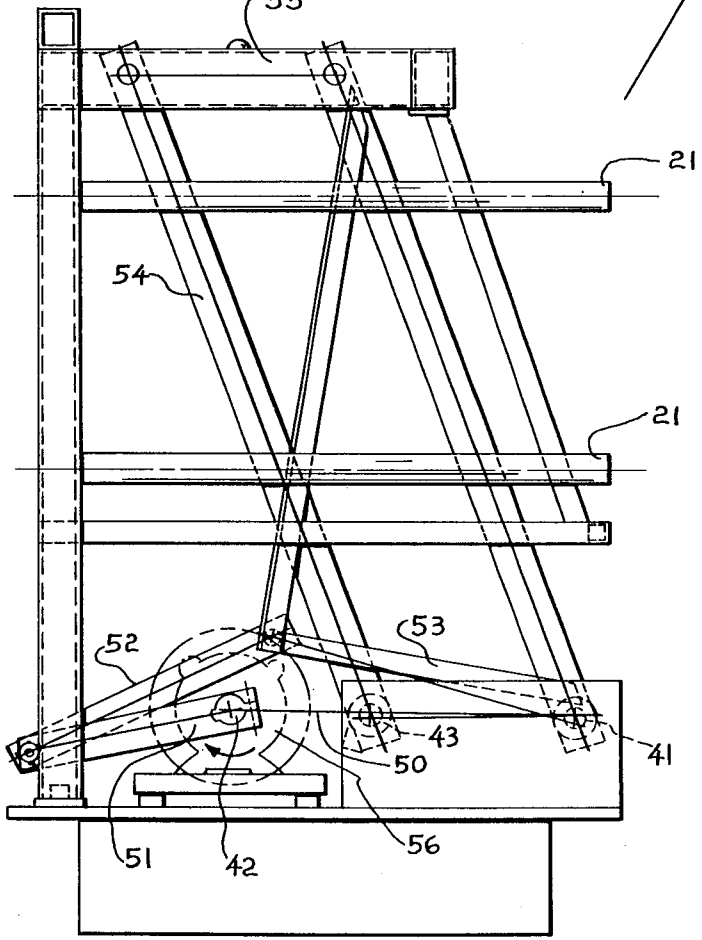
FIG. 5 is an elevational view taken along line 5—5 of FIG. 2 showing the linkages of the doff servant.
Figure 6B:
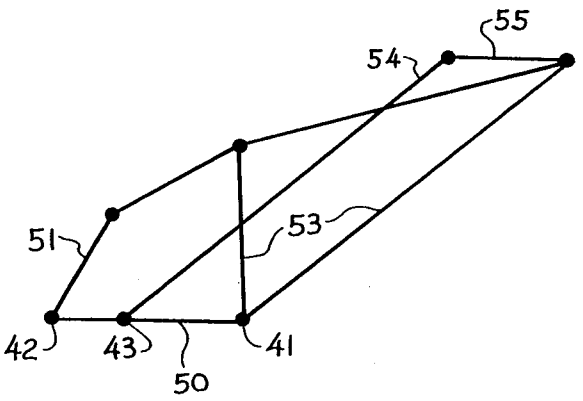
FIG. 6*b* is a diagram of the two four-bar linkages in the extended position.
Figure 6A:
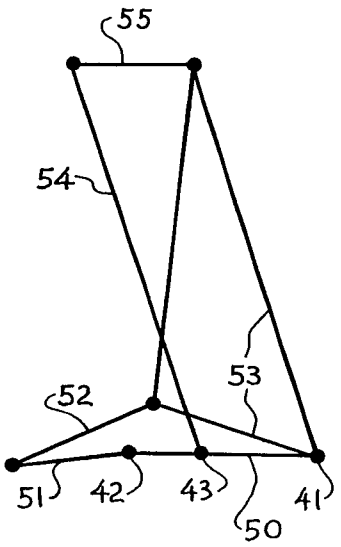
FIG. 6*a* is a diagram of the two four-bar linkages in the retracted position.

The doff frame is extended and retracted by means of two four-bar linkages (FIGS. 5, 6*a* and 6*b*), a first four-bar linkage drives the second. The first linkage comprises part of base 50 (a fixed link from pivot point 41 to pivot point 42), a link 51, a link 52, and triangular link 53. The second linkage comprises part of base 50 (a fixed link from pivot point 41 to pivot point 43), link 54, triangular link 53, and link 55 which is part of the extendable frame. Linkage motor 56 rotates clockwise to drive link 51 and index the linkages extending receiving frame 20 toward winder 12. The receiving frame is retracted from the winder within the 32" width of the servant when linkage motor 56 is rotated counterclockwise. FIG. 6*a* is a diagram of the two four-bar linkages in the retracted position, FIG. 6*b* is a diagram of two four-bar linkages in the extended position.

When frame 20 is fully extended and seated on alignment bar 23, the four receiving rods 21 are aligned vertically and horizontally with the chucks 25 on the winder. This is indicated by sensor 104 which detects contact with the alignment bar. A pair of rotary solenoids 24 actuated by the operator (FIG. 7*a*) insert rods into the windup cover to actuate push-off valves which supply air to the push-off cylinders in order to push packages 13 onto the receiving rods 21. Once the packages are received, the frame is retracted back into the servant by operator action. Sensor 103 assures that the frame is fully retracted without overtravel. The servant automatically travels to the unload station and pushes packages onto support rods at the unload station.

Figure 7B:
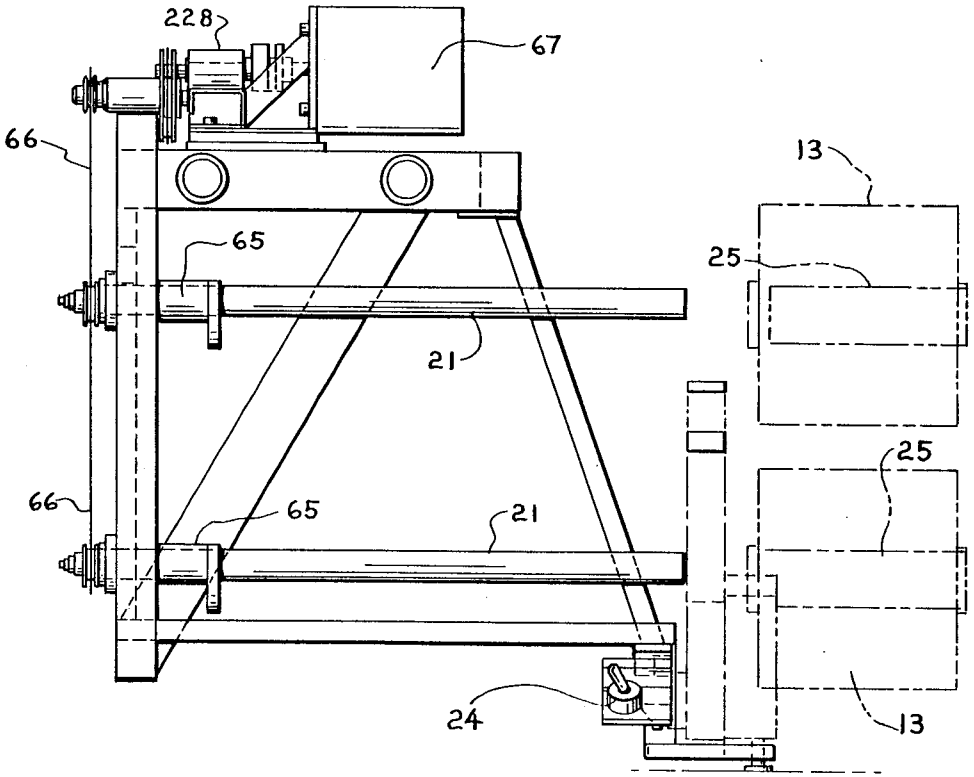
FIG. 7*b* is a side view of the doff frame showing the push-off mechanism.
Figure 7A:
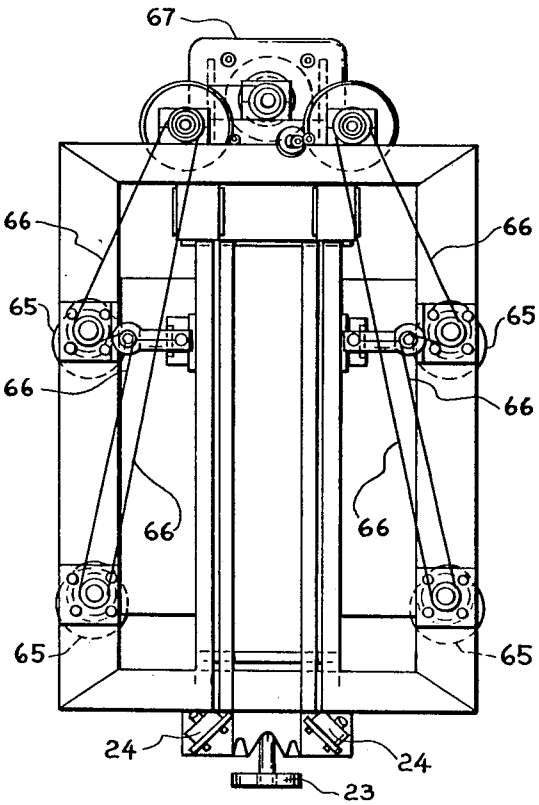
FIG. 7*a* is a rear view of the doff frame showing the push-off mechanism.
Figure 8:
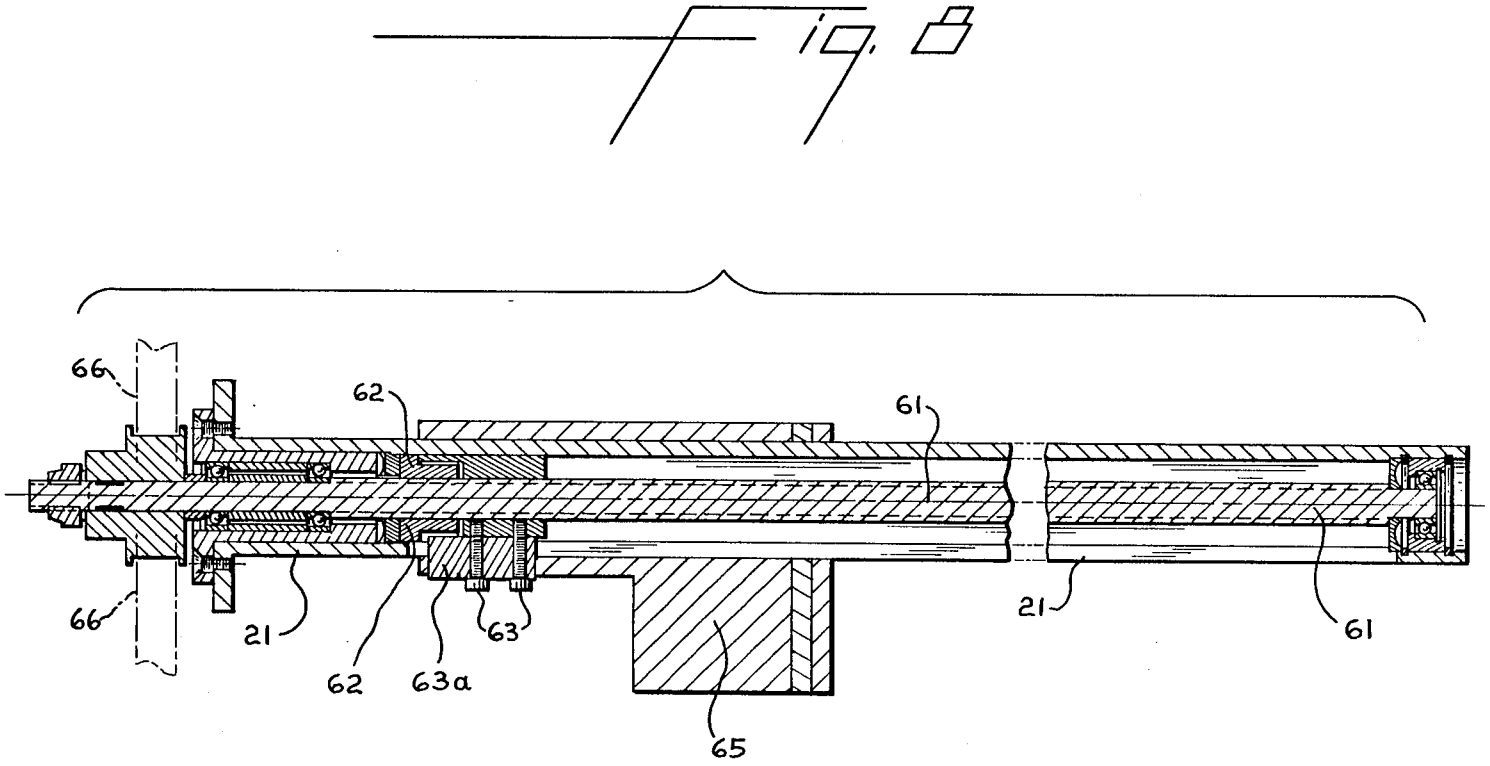
FIG. 8 is a cross-sectional view of a receiver rod taken along line 8—8 of FIG. 2 showing push-off mechanism components.

The servant push-off mechanism is best described with reference to FIGS. 7*a*, 7*b* and 8. Each of the four receiving rods 21 contain an internal lead screw 61 with a threaded nut 62. The nut 62 is attached by a key 63*a* and bolts 63 to pusher 65 which pushes the packages off. The screw 61 is powered by gear belts 66 which are driven by a single push-off motor 67 through clutch 228 located at the top of the doff frame. As screw 61 is rotated, nut 62 travels along the screw causing pusher 65 to move. The motor 67 runs on a timed sequence which is set to allow the motor to drive the pusher 65 into the spring cushioned stops at either end. The clutch 228 allows this operation without damage to the screw or nuts.

Figure 9:
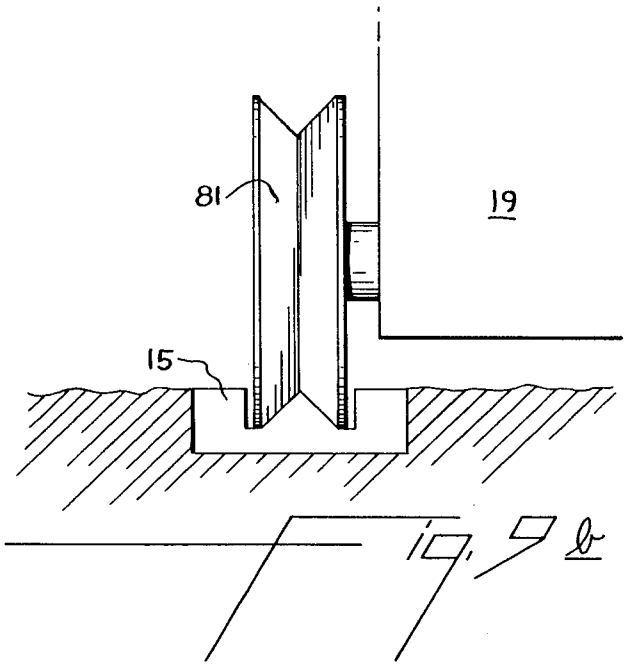
FIG. 9*a* is a top view of the servant transport system.
FIG. 9*b* is a side elevation of the drive wheel and track.
Figure 9A:
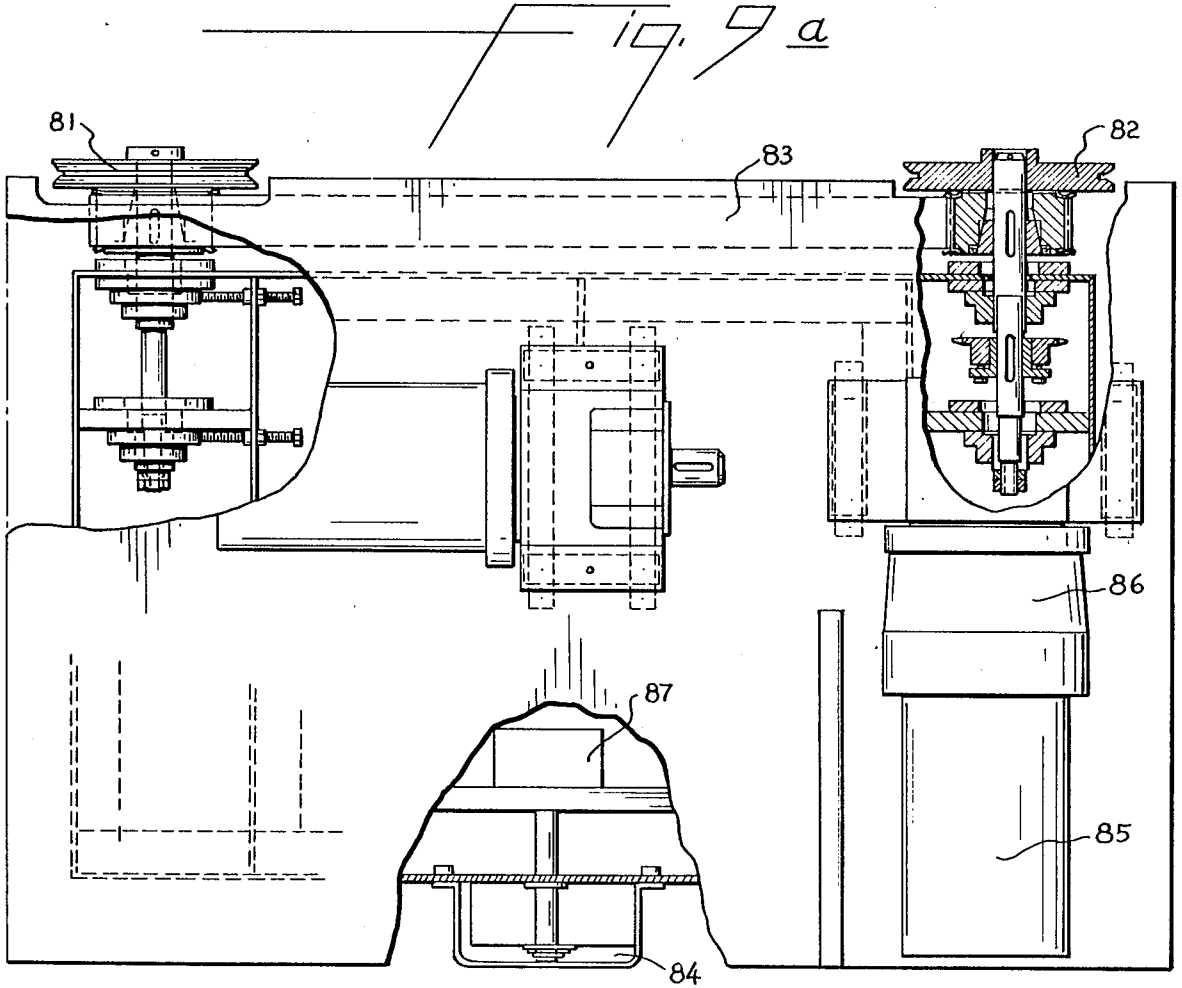

The transport system of the doff servant is best shown in FIGS. 9*a* and 9*b*. The servant is supported by three wheels. Two "V" wheelos 81 and 82 are belted together by gear belt 83 and the third wheel 84 is free and located on the windup side of the servant. Transport motor 85 drives harmonic gear box 86 with a 18:1 reduction which drives the "V" wheels 81 and 82 along "V" profile alignment track 15 in the floor parallel to the spinning machine. The third wheel 84 is also used for Emergency Stop (E-Stop) braking. An electromechanical brake 87 mounted beneath the base of the servant is actuated when either a safety bumper is deflected or the E-Stop button is pressed. The servant travels at 2 miles per hour and stops under emergency conditions in approximately 10 in.

Figure 11:
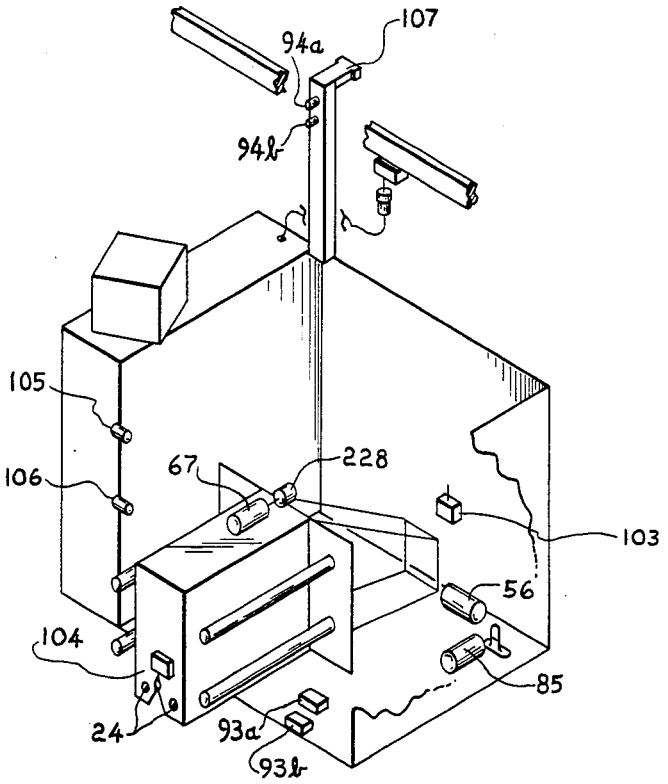
FIG. 11 is a schematic diagram, in perspective, showing the general location of the control elements of the doff servant.
Figure 12:
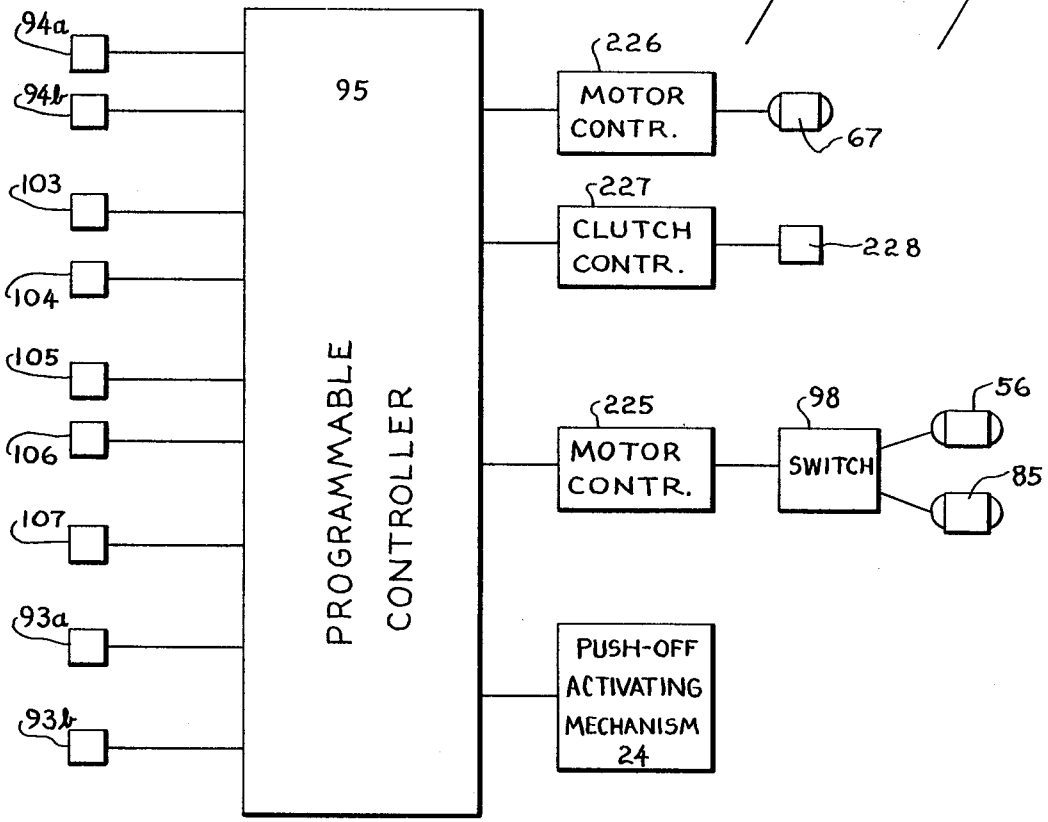
FIG. 12 is a block diagram of the control features of the doff servant of this invention.

The controls for the doff servant are shown in FIGS. 11, 12. The location of the controls are shown in a schematic view of the doff servant in FIG. 11. The servant communicates with the off-board programmable controller at the unload station by means of optical sensors 93*a* and 93*b*. Sensor 93*b* is a data output sender (Photoswitch/Electronics Corporation of America, Model No. 42 MRL-5000) emitting via light pulses the doff location it has just serviced. Sensor 93*a* is a data input receiver (Photoswitch/Electronics Corporation of America Model No. 42 MRR-5000) receiving via light pulses, a doff position number for then next doffing location. Upon receiving information as to the next doff location, programmable controller 95 (Allen-Bradly Mini PLC 2/15), housed within the servant, supplies signals to motor controller 225 to energize travel motor 85; and the doff servant travels to the next doffing location. Servant position and control sensors 94*a* and 94*b* (Cutler-Hammer Model No. E58CAL18A2R2) supply inputs to the programmable controller from reflective strips 250, 251, and 252 applied to the side of the power rail 90 (see FIG. 10). These sensors allow the servant to keep track of its location and direction of travel as described previously.

At the doff location, the operator moves the manual switch 98 to doff position. By operator activation, programmable controller 95 supplies signals to motor controller 225 to energize doff frame motor 56 which extends the receiving frame. Also by operator activation, programmable controller 95 supplies signals which actuate rotary solenoids in order to activate the windup push-off mechanism 24 for doffing. Four other sensors 103, 104, 105, and 106 provide inputs to the programmable controller 95 for determining if the servant is in condition for either the doffing mode or the travel mode. Sensor 104 is used to determine if the receiving frame is extended and engaged on the windup in readiness to receive packages. Sensor 103 detects if the doff frame is retracted within the width of the servant. The sensors 103 and 104 are Gould/R. B. Dennison Model No. M509S01-00. Sensors 105 and 106 (Cutler-Hammer Model No. E58CAL18A2R2) detect if the packages are properly positioned within the width of the servant on the receiving rods and are clear to travel.

When the servant is in condition for travel, the operator then moves manual switch 98 to the travel position. By operator activation, programmable controller 95 supplies signals to motor controller 225 to energize travel motor 85 and the servant automatically travels to the unload station. When the servant arrives at the unload station it first relays the position identification number to the off board programmable controller via data output sender 93*b*. Programmable controller 95 then supplies signals to motor controller 226 and clutch controller 227 to automatically activate the package push-off motor 67 and package push-off clutch 228 which pushes packages off onto unload station support rods.

Control and data transfer receiver 107 (Photoswitch/Electronics Corporation of America Model No. 42MRR-5000) has two functions. Signals from the off board controller to sensor 107 can be used to prevent the servant from returning to the unload station in the event of conflicting activity. The second function of sensor 107 is to coordinate data transfer between sensors 93*a*, 93*b*, and the off-board programmable controller.

In operation, when positioned at unload station 16, servant 10 is directed by an off-board programmable controller by means of optical sensor 93*b* to automatically position itself at a specific doff location. An area control computer directs the off-board controller and also displays the doff schedule on monitor screens throughout the spinning area, thus directing the operator to the proper doff location. The servant automatically travels to the doff location and stops by the stopping mechanism previously described. The operator moves the travel/doff switch 98 on operator control panel 97 to doff position and then pushes a button which extends receiving frame 20 across 42" service aisle 14 where four receiving rods 21 align with windup chucks 25. The operator then pushes another button which actuates rotary solenoids 24 in order to activate the windup push-off mechanism as described above. Once the eight packages are pushed off onto the receiving rods, the operator pulls the "extend and retract" button to retract the frame within the 32" width of the servant. The operator then moves the travel doff switch to travel, pushes the release button and the servant automatically travels to the unload station. When the servant arrives at the unload station, upon a signal from the off-board programmable controller it first relays the position indentification number to the off-board programmable controller then automatically pushes the packages off onto unload station support rods by the push-off mechanism described above. The servant is then ready to repeat the cycle.

The operator performs all other operations at each position including pre and post doff inspections, cut down, chuck braking, donning of tubes and stringup.

We claim:

1. In a winding apparatus having a plurality of windups, each windup being located on one side of a service aisle and including a rotatable chuck and a push-off device mounted to the windup for moving yarn packages from the chuck, an apparatus for receiving yarn packages from the chucks as they are doffed from the windups by said push-off devices and delivering said packages to an unload station, said apparatus comprising:

(a) a carriage mounted for movement into a spaced relationship on the other side of the service aisle opposite a respective windup;

(b) means to align said carriage with a respective windup;

(c) an extendable and retractable frame mounted to said carriage, said frame having rods attached thereto, said rods being directed into alignment with the chucks of said respective windup when said frame is extended;

(d) a retractable push-off mechanism mounted on said frame and associated with said rods; and (e) means for extending and retracting said frame across said service aisle toward and away from said respective windup.

2. The apparatus as defined in claim 1, wherein means for extending and retracting said frame includes two four-bar linkages coupled to said carriage and frame and to each other.

* * * * *